United States Patent [19]

Dominguez

[11] Patent Number: 4,766,716

[45] Date of Patent: Aug. 30, 1988

[54] ADJUSTABLE GUIDE ROLLER ASSEMBLY FOR TUBE FORMING APPARATUS

[75] Inventor: Ben Dominguez, Pasadena, Tex.

[73] Assignee: Formers of Houston, Inc., Pasadena, Tex.

[21] Appl. No.: 104,815

[22] Filed: Nov. 12, 1987

[51] Int. Cl.[4] ..... B65B 9/06

[52] U.S. Cl. ..... 53/551; 53/389; 226/174; 226/194

[58] Field of Search ..... 53/551, 552, 389; 226/174, 180, 194, 199

[56] References Cited

U.S. PATENT DOCUMENTS

| | | | |
|---|---|---|---|
| 2,955,398 | 10/1960 | Dreeben | 53/589 X |
| 3,027,696 | 4/1962 | Leasure | 53/552 X |
| 3,067,555 | 12/1962 | Newell | 53/551 |
| 3,641,736 | 2/1972 | Dwyer | 53/551 |
| 4,501,109 | 2/1985 | Monsees | 53/551 X |

*Primary Examiner*—John Sipos

*Attorney, Agent, or Firm*—Neal J. Mosely

[57] ABSTRACT

An adjustable guide roller assembly installed on the tube forming apparatus of form-fill-seal packaging machines of the type having a tube former and depending tubular fill pipe through which quantities of product are passed and over which a strip of packaging material is pulled to progressively form the material into a depending and upwardly open tubular configuration and subsequently sealed to form product bearing packages. The adjustable guide roller assembly is removably mounted on the back of the tube former adjacent the curved shaping portion which receives the strip material and is pivotally and horizontally movable relative thereto to receive and adjustably position the strip material thereon. The guide roller member of the assembly is capable of being pivotally raised above the top of the lowermost surface of the shaping portion of the former to clear the machine framework supporting the former allowing it to be removed horizontally outward from the packaging machine.

23 Claims, 1 Drawing Sheet

FIG. 1
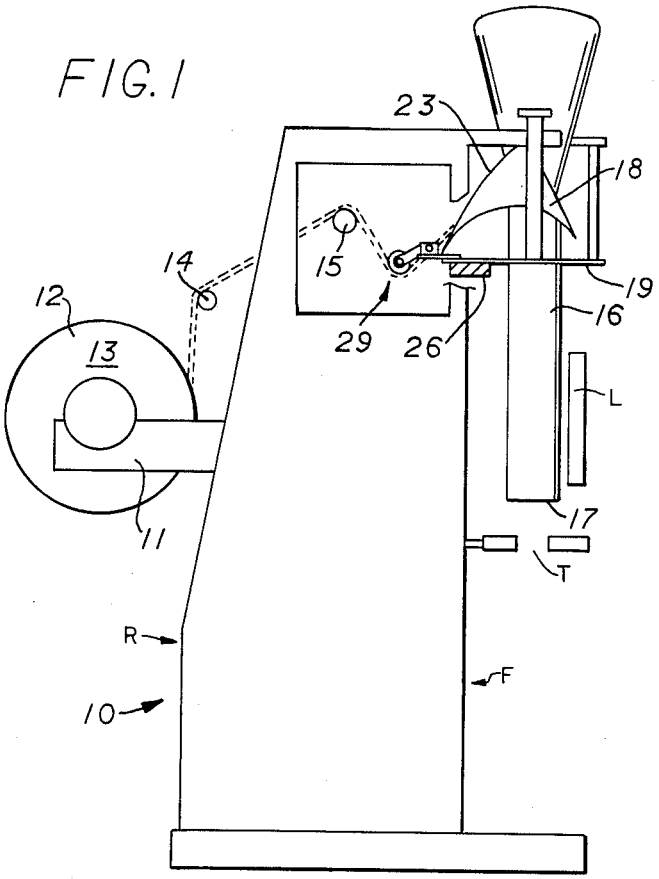
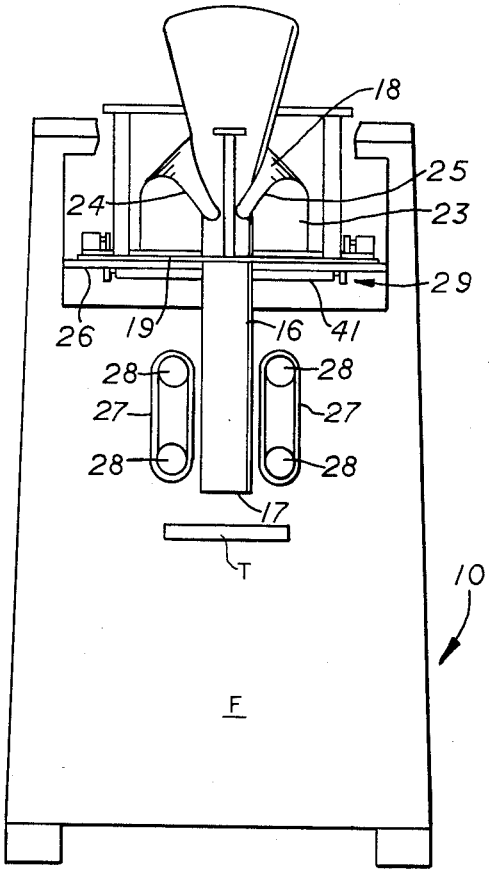
FIG. 2
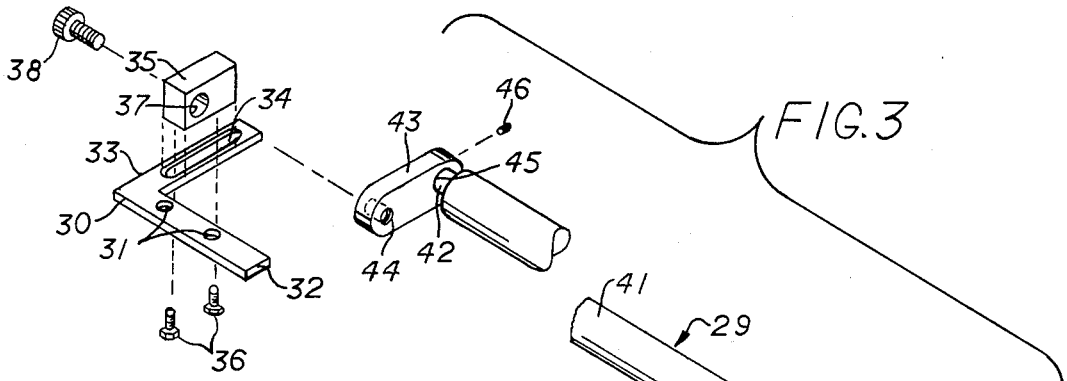
FIG. 3
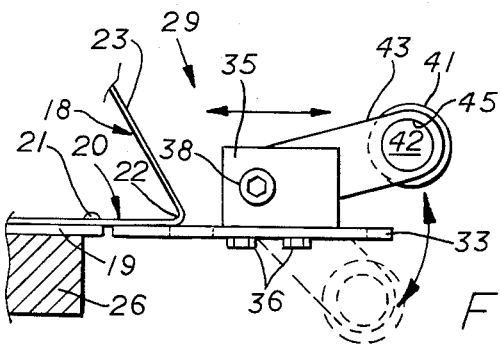
FIG. 4

ADJUSTABLE GUIDE ROLLER ASSEMBLY FOR TUBE FORMING APPARATUS

BACKGROUND OF THE INVENTION

1. Field of the Invention

This invention relates generally to packaging apparatus, and more particularly to an adjustable guide roller for installation on the tube shaping former of form-fill-seal packaging apparatus to provide proper positioning and tension of the material as it passes over the former and which allows easy removal of the former from the packaging apparatus.

2. Brief Description of the Prior Art

Packing machines of the so-called vertical form-fill-seal class are known in the art. Machines of this type guide a web of flexible packaging material from a supply roll of the material over a forming hood commonly known as a "former", where it is formed into an open ended tubing tubular configuration, intermittently fed downward, sealed to form a longitudinal tube seam, filled with a product, and ultimately sealed at package length intervals and cut into individual packages.

The "former" surrounds the upper portion of a fill pipe, and a dosing device cooperates with the mouth of the fill pipe for gravity feeding the material to be packaged into the fill pipe.

Most machines of the above described type incorporate a guide roller which is fixed to the machine frame or to the plate which supports the "former." Replacing or removing the fixed roller assemblies from the machine is time consuming and costly because it is necessary to unbolt and raise the dosing device above the top of the former and then lift the former assembly up and forwardly out of the machine so that the fixed roller assembly will clear the machine framework.

There are several patents which disclose packaging machines with various fixed guide roller assemblies.

Dreeben, U.S. Pat. No. 2,955,398 discloses a packaging machine feed mechanism particularly suited to accommodate highly elongatable materials such as polyethylene. The mechanism comprises a slack controller interposed between the web roll and the forming tube. The slack controller includes a spring biased brake arm carried on a pivot pin supported by the machine frame which controls the withdrawal the material from the web roll in timed sequence with the reciprocating gripping jaws which pull the packaging material over the forming tube. A guide roller is mounted on a carriage carried by the frame of the machine.

Wilson, U.S. Pat. No. 3,415,171 discloses a package forming machine having a split tube former which is laterally expandable. The strip of packaging material is fed past a series of guide rollers and is directed somewhat laterally over a guide shoulder portion of the former.

Leasure, U.S. Pat. No. 3,027,695 discloses a packaging apparatus having a vertically reciprocating former and a roller member under which the strip of packaging material passes and which is movable with the reciprocating former.

Lasko, U.S. Pat. No. 2,113,658 discloses a packaging machine in which the sheet of packaging material is delivered from the supply roll over a guide roller and between a pair of gear driven feed rolls after which it is guided over a triangular apron. The guide roller is connected to the framework of the machine and may be adjusted so that the sheet will properly enter between the two feed rolls.

The present invention is distinguished over the prior art in general, and these patents in particular by the provision of an adjustable guide roller assembly installed on the tube forming apparatus of form, fill and seal packaging machines which have a depending tubular fill pipe through which quantities of product are passed and over which a strip of packaging material is pulled to progressively form the material into a depending and upwardly open tubular configuration and subsequently sealed to form product bearing packages. The adjustable guide roller assembly is removably mounted on the back of the tube former adjacent the curved shaping portion which receives the strip material and is pivotally and horizontally movable relative thereto to receive and adjustably position the strip material thereon. The guide roller member of the assembly is capable of being pivotally raised above the top of the lowermost surface of the shaping portion of the former to clear the machine framework supporting the former allowing it to be removed horizontally outward from the packaging machine.

SUMMARY OF THE INVENTION

It is therefore an object of the present invention to provide an adjustable guide roller assembly for installation on the tube forming member of form-fill-seal packaging apparatus to adjustably position the packaging material thereon.

It is another object of this invention to provide an adjustable guide roller assembly for installation on the tube forming member of form-fill-seal packaging apparatus which will adjust the tension of the packaging material to compensate for the frictional wear caused by the material pressing and moving over the tube forming member.

Another object of this invention is to provide an adjustable guide roller assembly for installation on the tube forming member of form-fill-seal packaging apparatus which will substantially reduce the cost and down time required to remove the forming member from the packaging machine.

A further object of this invention is to provide an adjustable guide roller assembly for installation on the tube forming member of form-fill-seal packaging apparatus which allows the tube forming member to be removed horizontally from the packaging machine without the necessity of unbolting and raising the dosing device.

A still further object of this invention is to provide an adjustable guide roller assembly for installation on the tube forming member of form-fill-seal packaging apparatus which is simple in design, economical to manufacture, and rugged and durable in use.

Other objects of the invention will become apparent from time to time throughout the specification and claims as hereinafter related.

The above noted objects and other objects of the invention are accomplished by providing an adjustable guide roller assembly installed on the tube forming apparatus of form, fill and seal packaging machines which have a depending tubular fill pipe through which quantities of product are passed and over which a strip of packaging material is drawn or pulled to progressively form the material into a depending and upwardly open tubular configuration and subsequently sealed to form product bearing packages. The adjustable guide roller assembly is removably mounted on the back of the tube former adjacent the curved shaping portion which receives the strip material and is pivotally and horizontally movable to receive and adjustably position the strip material thereon. The guide roller member of the assembly is capable of being pivotally raised above the top of the lowermost surface of the shaping portion of the former to clear the machine framework supporting the former allowing it to be removed horizontally outward from the packaging machine.

BRIEF DESCRIPTION OF THE DRAWINGS

FIG. 1 is a side elevation view of a form-fill-seal packaging machine having an adjustable guide roller installed on the tube forming apparatus.

FIG. 2 is a front elevation view of the packaging machine of FIG. 2.

FIG. 3 is an exploded isometric view of the adjustable guide roller in accordance with the present invention.

FIG. 4 is a side elevation view of the adjustable guide roller assembly.

DESCRIPTION OF THE PREFERRED EMBODIMENT

Referring to the drawings by numerals of reference, there is shown in FIGS. 1 and 2, a bagging or packaging machine 10 of the type used to form a sheet of plastic, foil, or other material into a bag, fill the bag with a food product, and seal the formed bag. The front side of the machine is identified generally with F and the backside of the machine identified generally with R.

A mounting bracket 11 for receiving a roll 12 is provided on the backside of the machine, which roll consists of a wound strip of packaging or bagging material 13. Common bag or packaging materials comprise weldable plastic foil, paper, or cellophane. The bagging material 13 is guided over one or more idler rolls 14 and 15 from the backside R to the front side F.

A tubular fill pipe 16 which extends to the head of the machine and terminates at 17 is provided on the front side F of the machine. The upper portion of the fill pipe 16 is surrounded by a shaping member 18 which curves the sheet of packaging material into a tubular configuration as it moves from the rollers 14 and 15. Shaping member 18 is known in the art as a "former".

The former 18 is formed of sheet metal and is constructed for assembly on the fill pipe 16 and a flat horizontal support plate 19. The former 18 has a flat base portion 20 which is secured by conventional means, such as sheet metal screws 21 to the support plate 19. The back portion of the former is bent at an acute angle along a fold line 22 and curves upwardly and inwardly from the base portion to form a curved or arcuate surface 23. The front portion of the former curves downwardly around the fill tube to form a pair of opposed lateral forming wings 24 and 25. The horizontal support plate 19 aids in strengthening the curved sheet metal former configuration and supports the former in the packaging machine. The former 18 is removably supported on a beam or cross member 26 in the packaging machine.

During the operation of the packaging machine (described hereinafter), the bagging material 13 is received at the rear portion of the former and drawn over the curved surface 23 and is progressively formed into a depending and upwardly open tubular configuration, opposite longitudinal edge portions of the material being progressively juxtaposed by the forming wings 24 and 25 in parallel vertically extending relationship.

A dosing device (not shown) cooperates with the mouth of the fill pipe 16 for gravity feeding the material to be packaged into the fill pipe. A longitudinal sealing member L is provided adjacent the fill pipe 16 and a transverse sealing member T is provided beneath the bottom of the fill pipe.

A pair of horizontally spaced vertically extending transfer belts 27 respectively externally engage opposite sides of the tubular formed bagging material to draw the same downwardly through the former. The transfer belts 27 are arranged on the sides of the fill pipe 16. The transfer belts 27 are continuous belts, which are driven by a motor over rollers 28 in opposite directions and at equal peripheral speeds to intermittently and sequentially draw the bagging material downwardly. During the movement of the belts 27, a part of the bagging material 13 is pulled downwardly corresponding to the bag length.

Incident to forming the bag-like packages, the bagging material 13 which is of uniform width, is fed past a final guide roller assembly 29 which is adjustable to provide proper positioning and tension of the material as it passes over the former 18.

For various reasons, the formers must be removed from the machine often. Most machines of the prior art incorporate a guide roller which is fixed to the machine frame or to the plate which supports the former. Removing the formers having fixed roller assemblies from the machine is time consuming and costly because it is necessary to unbolt and raise the dosing device above the top of the former and then lift the former assembly up and forwardly out of the machine so that the fixed roller assembly will clear the machine framework.

As seen in FIGS. 3 and 4, adjustable guide roller assembly 29 comprises a pair of opposed L-shaped brackets 30 mounted at the rear of the former 18 on the flat base portion 20. Each bracket 30 has a pair of holes 31 in one leg 32 for mounting the bracket to flat base portion 20 at the rear of the former 18. The other leg 33 of the bracket 30 has a longitudinal slot 34 which extends rearward from the rear of the former and horizontal relative to the vertical axis of the former.

A clamping member in the form of a rectangular block 35 is movably secured to the top of each bracket 30 with bolts 36 received through the slots 34. The blocks 35 are adjustably movable in slots 34 inwardly and outwardly relative to the rear of the former 18. A hole 37 extends horizontally through each block 35 and receives a cap screw 38 which extends outwardly from the hole to one side of the block.

An elongate tubular roller 41 is rotatably journaled on axle rods 42 at each end. A rectangular link member 43 is disposed at each end of the roller 41 and has holes 44 and 45 at opposite ends. The outer ends of the axle rods 42 are slidably received in the holes 45 in the link members 43 and are secured therein by means of a set screw 46.

Hole 44 of each link member 43 is internally threaded to threadedly receive the extended end of the cap screw 38. The cap screw 38 may be tightened to secure the link members 43 against the blocks and prevent undesired movement.

To adjust the position the roller assembly, the bolts 36 maybe loosened and the blocks 35 can be moved forward or backward relative to the former 18 and then retightened. The vertical position of the roller 41 may be adjusted by loosening the cap screws 38 to pivotally move the link members 43 and roller 41 about the cap screw axis. The horizontal and pivotal positioning of the roller 41 relative to the rear of the former 18 allows more precise tension of the material as it is fed over guide roller 41 and the former 18.

The former assembly can also be easily removed from the machine by loosening the cap screws 38 and pivotally raising the roller 41 to clear the supporting crossmember 26 and machine framework and pulling the former assembly forward and outward from the machine.

OPERATION

The operation of the apparatus should be apparent from the foregoing description of the component parts and their mode of assembly. Nevertheless, a detailed description of the operation will be given for clarification and understanding of the invention.

When the machine is activated, the bagging material 13 is pulled by means of the transfer belts 27 over the guide roller 41 and over the former 18. As the material passes over the former it is progressively formed into a depending and upwardly open tubular configuration, opposite longitudinal edge portions of the material being progressively juxtaposed by the former in parallel vertically extending relationship. During a forming of the bagging material 13 into a tube shape, the juxtaposed side edges of the material are positioned adjacent the longitudinal sealing member L. During a stand still time of the bagging material, the sealing member L is pressed onto the fill pipe 16 and the overlapping edges are welded together using heat or other conventional sealing methods to fix the packaging material into a tubular configuration.

The transverse sealing member T simultaneously produces a head seam on a lower bag and a bottom seam on an upper bag. Simultaneously with the creation of these seams, or shortly thereafter, the lower finished bag is separated between the two transverse seams from the upper bag, which must still be produced. Fill material is dispensed, by gravity or otherwise, through the fill pipe via a dosing device located thereabove to fill the empty bag.

To adjust the position the guide roller assembly, the bolts 36 may be loosened and the blocks can be moved forward or backward relative to the former 18 and then retightened. The vertical position of the roller 41 may be adjusted by loosening the cap screws 38 to pivotally move the link members 43 and roller 41 about the cap screw axis. The horizontal and pivotal positioning of the roller 41 relative to the rear of the former 18 allows more precise tension of the material as it is fed over guide roller 41 and the former 18.

If for some reason, the former must be removed from the machine, the cap screws 38 are loosened and the roller 41 is pivotally raised to clear the supporting crossmember 26 and machine framework. The former assembly may then be pulled forward and outward from the machine.

While this invention has been described fully and completely with special emphasis upon a preferred embodiment, it should be understand that within the scope of the appended claims the invention may be practiced otherwise than as specifically described herein.

What is claimed is:

1. In a form, fill and seal packaging machine comprising;

a supporting frame, means for supporting a rolled strip of elongated, flexible, sealable packaging material on said frame, a vertical tube former having a support plate supported on said frame and adapted to receive said strip of packaging material and progressively form the same to a depending and upwardly open tubular configuration, with opposite longitudinal edge portions of said strip of packaging material being progressively juxtaposed by said former in parallel vertically extending relationship, means for horizontally removably mounting said support plate on said frame, a guide roller assembly removably mounted on said tube former on said frame and movable relative thereto to receive and position said strip of packaging material adjustably thereon, means for mounting said guide roller assembly for pivotal movement above the top of said former support plate sufficiently to clear said machine frame when said former is pulled horizontally from said machine, a tubular fill pipe associated with said former and depending therefrom, with the formed tube of packaging material surrounding the exterior surface and through which measured quantities of product are passed, product dispensing means associated with said former and operable for the gravity discharge of measured quantities of product through said fill pipe to the formed tube interior through its upwardly open end, longitudinal seam sealing means disposed beneath said former adjacent said fill pipe and movable relative thereto into and out of sealing engagement with the juxtaposed edge portions of the tubular configuration, intermittently operable tube advancing means adjacent said tubular fill pipe cooperative therewith to draw said tube downwardly therebetween whereby successively to present integral blanks in tubular form at said longitudinal seam sealing means, and end sealing means disposed beneath said fill pipe and operable intermittently to seal transversely end portions of said tubular blanks to form product bearing packages.

2. A form, fill and seal packaging machine according to claim 1 wherein said guide roller assembly is adjustable to provide selective tension of said strip of packaging material being drawn over said roller assembly and said former by said tube advancing means.

3. A form, fill and seal packaging machine according to claim 1 wherein said guide roller assembly is mounted for horizontal movement to provide selective tension of said strip of packaging material being drawn over said roller assembly and said former by said tube advancing means.

4. A form, fill and seal packaging machine according to claim 1 wherein said guide roller assembly is mounted on said tube former for pivotal and horizontal movement relative thereto to provide selective tension of said strip material as it is drawn over said roller assembly and said former by said tube advancing means.

5. A form, fill and seal packaging machine according to claim 1 in which said guide roller assembly comprises a pair of brackets mounted at the rear of the former on the former support plate, a clamping member movably mounted on each said bracket for selective adjustable horizontal positioning inwardly and outwardly relative to the rear of the former, a pair of link members each releasably clamped at one end by each said clamping member for pivotal movement relative thereto and their other ends extending outwardly therefrom, an elongate tubular roller extending between the outwardly extending ends of said link members and rotatably journaled at each end thereto, said clamping members and said link members providing selective horizontal and pivotal positioning of said roller relative to the rear portion of said former to receive and adjustably position said strip material thereon, and.

the horizontal and pivotal positioning of said roller relative to the rear of the former providing selective tension of said strip material as it is drawn over said roller and said former by said tube advancing means.

6. A form, fill and seal packaging machine according to claim 5 in which said brackets are generally L-shaped and have one or more holes in one leg for securing same to the rear of said former and the other leg of the bracket is provided with a longitudinal slot which extends rearward from the rear of said former and horizontal relative to the vertical axis of said former.

7. A form, fill and seal packaging machine according to claim 6 in which said brackets are releasably secured to said former support plate.

8. A form, fill and seal packaging machine according to claim 6 in which said clamping member is releasably and slidably secured to said bracket with bolts received through said slots.

9. A form, fill and seal packaging machine according to claim 5 in which;

said elongate tubular roller extending between the outwardly extending ends of said link members is rotatably journaled at each end on axle rods releasably secured to the extended ends of said link members.

10. A form, fill and seal packaging machine according to claim 5 in which;

each said clamping member is a rectangular block member having a hole extending horizontally therethrough and a cap screw received therein and extending outwardly from the hole to one side of said block and the extended end threadedly received in one end of said link member to tighten the same against said block.

11. A form, fill and seal packaging machine according to claim 10 in which;

said link members are provided with an internally threaded hole at one end to threadedly receive the extended end of said cap screw, and said cap screw being operative to tighten said link members and said block members together to secure said link members in selective positions against movement.

12. A former for turning a thin strip of flexible packaging material into a tube and being removably supported on a machine framework of a vertical form, fill and seal packaging machine, comprising;

means for horizontally removably mounting said former on said framework, a shaping portion adapted to receive said strip material and progressively form the same to a depending and upwardly open tubular configuration, opposite longitudinal edge portions of the material being progressively juxtaposed by said former in parallel vertically extending relationship, a tubular fill pipe associated with said former and depending therefrom, the formed tubular configuration surrounding the exterior surface and through which measured quantities of product are passed, and a guide roller assembly removably mounted on said shaping portion adjacent the portion receiving the strip material and movable relative thereto to receive and adjustably position said strip material thereon, means for mounting said roller guide assembly on said shaping portion for pivotal movement relative thereto and capable of being pivotally raised above the top of the lowermost surface of said shaping portion sufficient to clear the machine framework supporting the former when pulled horizontally from the packaging machine.

13. A tube former according to claim 12 wherein said guide roller assembly is mounted on said shaping portion for pivotal movement relative thereto to provide selective tension of said strip material during forming into a tube.

14. A tube former according to claim 12 wherein said guide roller assembly is mounted on said shaping portion for horizontal movement relative thereto to provide selective tension of said strip material during forming into a tubular configuration.

15. A tube former according to claim 12 in which said guide roller assembly is mounted on said shaping portion for pivotal and horizontal movement relative thereto to provide selective tension of said strip material as it is progressively formed into the tubular configuration.

16. A tube former according to claim 12 wherein said guide roller assembly is mounted on said shaping portion for pivotal and horizontal movement relative thereto to provide selective tension of said strip material as it is progressively formed into the tubular configuration.

17. A tube former according to claim 12 wherein said guide roller assembly comprises a pair of brackets mounted at the rear of the former adjacent the portion receiving the strip material, a clamping member movably mounted on each said bracket for selective adjustable horizontal positioning inwardly and outwardly relative to the rear of the former, a pair of link members each releasably clamped at one end by each said clamp member for pivotal movement relative thereto and their other ends extending outwardly therefrom, an elongate tubular roller extending between the outwardly extending ends of said link members and rotatably journaled at each end thereto, said clamping members and said link members providing selective horizontal and pivotal positioning of said roller relative to the rear portion of said former to receive and adjustably position said strip material thereon, and the horizontal and pivotal positioning of said roller relative to the rear of the former providing selective tension of said strip material as it is drawn over said roller and said former by said tube advancing means.

18. A tube former according to claim 17 in which said brackets are generally L-shaped and have one or more holes in one leg for securing same to the rear of said former and the other leg of the bracket is provided with a longitudinal slot which extends rearward from the rear of said former and horizontal relative to the vertical axis of said former.

19. A tube former according to claim 18 in which said brackets are releasably secured at the rear of the former adjacent the portion receiving the strip material.

20. A tube former according to claim 18 in which said clamping member is releasably and slidably secured to said bracket with bolts received through said slots.

21. A tube former according to claim 17 in which;

said elongate tubular roller extending between the outwardly extending ends of said link members is rotatably journaled at each end on axle rods releasably secured to the extended ends of said link members.

22. A tube former according to claim 17 in which;

each said clamping member is a rectangular block member having a hole extending horizontally therethrough and a cap screw received therein and extending outwardly from the hole to one side of said block and the extended end threadedly received in one end of said link member to tighten the same against said block.

23. A tube former according to claim 22 in which;

said link members are provided with an internally threaded hole at one end to threadedly receive the extended end of said cap screw, and said cap screw being operative to tighten said link members and said block members together to secure said link members in selective positions against movement.

* * * * *